United States Patent [19]

Diggins

[11] Patent Number: 4,504,018

[45] Date of Patent: Mar. 12, 1985

[54] PARTICLE CLASSIFIER APPARATUS AND METHOD WITH RUDDER CONTROL VANE

[75] Inventor: Joseph P. Diggins, Coraopolis, Pa.

[73] Assignee: Foster Wheeler Energy Corporation, Livingston, N.J.

[21] Appl. No.: 449,054

[22] Filed: Dec. 13, 1982

[51] Int. Cl.[3] ..... B04C 5/103

[52] U.S. Cl. ..... 241/53; 241/79.1; 209/144

[58] Field of Search ..... 241/53, 19, 58; 209/144, 139 A, 139 R; 55/416, 398, 396

[56] References Cited

U.S. PATENT DOCUMENTS

| | | | |
|---|---|---|---|
| 778,452 | 12/1904 | Hitzel | 209/139.1 |
| 2,100,734 | 11/1937 | Crites | 209/144 |
| 2,368,961 | 2/1945 | Arnold | 209/144 |
| 2,806,551 | 9/1957 | Heinrich | 55/416 |
| 2,868,462 | 1/1959 | Bogot et al. | 209/144 |
| 3,098,036 | 7/1963 | Neumann | 209/144 |

FOREIGN PATENT DOCUMENTS

| | | | |
|---|---|---|---|
| 501797 | 2/1930 | Fed. Rep. of Germany | 241/53 |
| 2051533 | 3/1979 | Fed. Rep. of Germany | 209/144 |
| 313690 | 4/1928 | United Kingdom | 241/53 |

*Primary Examiner*—Frank W. Lutter
*Assistant Examiner*—William Bond
*Attorney, Agent, or Firm*—Marvin A. Naigur; John E. Wilson; Martin Smolowitz

[57] ABSTRACT

A particle classifier apparatus and method for separating coarse particles from a mixture of particles carried in a gas stream, for preferred use in combination with a coal crushing mill. In the classifier, the gas-solids stream is passed through a plurality of internal upper angled fixed vanes for imparting a rotational motion to the particles. The rotating gas-solids stream then flows downwardly past 3–6 pivotable deflector vanes located entirely within the rotating gas-solids stream for effectively separating the larger size particles in the gas stream from the smaller particles. The smaller particles are then carried upwardly by the gas stream, such as coal particles carried by an air stream into a combustion zone of a boiler, while the larger size particles are returned downwardly, such as to a crusher for further size reduction and for recycling the particles through the classifier.

18 Claims, 2 Drawing Figures

PARTICLE CLASSIFIER APPARATUS AND METHOD WITH RUDDER CONTROL VANE

BACKGROUND OF INVENTION

This invention pertains to a particle classifier apparatus and method for separating solid particles carried in a gas stream according to their particle size. It pertains particularly to a particle classifier apparatus and method used for separating and removing fine coal particles carried in an air stream as a fuel feed stream for firing a boiler, and returning larger coal particles to a crusher for further size reduction.

Particle classifiers of various types such as coal classifiers have been known and used in the power industry for many years, and are located between a coal crushing or grinding mill and the pulverized coal feed as fuel to steam boilers. Such classifiers control the particle size of the coal feed to the boiler combustion zone to a desired size range. The classifiers typically utilize centrifugal and gravity forces on the particles to achieve a selective separation of the larger particles from smaller particles.

Some typical particle classifiers are disclosed in U.S. Pat. Nos. 2,485,255; 2,868,462; and 3,098,036. However, most such classifiers have not been able to provide a desired degree of control of the particle sizes. In many classifiers, radially oriented vanes are usually initially set and are seldom changed due to the low effectiveness of such vanes in controlling the coal particle size. However, these particle size control problems have been substantially overcome by use of the present invention, which uses two sets of flow control vanes in a series flow arrangement.

SUMMARY OF INVENTION

The present invention provides an improved particle classifier apparatus and method for separating according to size solid particles carried in a gas stream, and in which the particle size separation is effectively controlled by at least three pivotable vanes located entirely within the rotating gas-solids flow stream. The invention comprises a particle classifier apparatus for separating large particles from a mixture of small and large particles carried in a gas stream, including: a cylindrical vertically-oriented housing having an upper head and a central opening extending through the head for removal of gas and fine particle solids; multiple angled circumferentially-spaced vanes fixedly attached to the upper head for imparting a rotational motion to a gas-solids mixture passing therethrough; an inner conical-shaped casing located below and attached to the lower ends of the multiple vanes so as to provide an annular passageway between the housing and the conical casing for upward flow of gas-solids mixture therethrough; multiple pivotable deflector vanes mounted radially inwardly of said conical casing, each vane being pivotable about its own axis and having its pivot axis inclined from the vertical and located within the rotational flow path of the gas carried particles, whereby the pivot angle of said vanes is adjustable so as to control the flow velocity and degree of separation of the solid particles; and at least one closable opening at the lower end of the conical casing for removal of the larger separated particles downwardly from the classifier.

The classifier utilizes an upflowing gas stream which carries a gas-solids particle mixture upwardly though an annular shaped passageway in the classifier cylindrical housing, then generally radially inwardly through multiple angled vanes which impart a rotational flow pattern to the gas-solids stream. The gas-solids then flows past at least three pivotable deflector vanes located in the gas-solids stream, and pivotally adjusting the flector vanes and separating the larger particles from the smaller particles by controlling the velocity and centrifugal forces on the particles by the angular position of the pivotable vanes, so as to accomplish the desired degree of particle separation. The gas and fine particles are passed upwardly and removed through a central opening in the housing upper head, while the separated larger particles are returned downwardly through lower openings equipped with closure means to prevent backflow of the gas.

The particle classifier is usually mounted directly above a crusher device for pulverizing the returned larger particles along with fresh particulate feed material. The classifier apparatus and method is usually used in combination with a coal crushing device or mill for providing a feed stream of fine particulate coal and combustion air to the burners of a steam boiler. It is an advantage of the present invention that it provides effective classification of particles at lower flow velocities and over a wide range of gas/solids ratios.

DETAILED DESCRIPTION OF INVENTION

Figure 1:
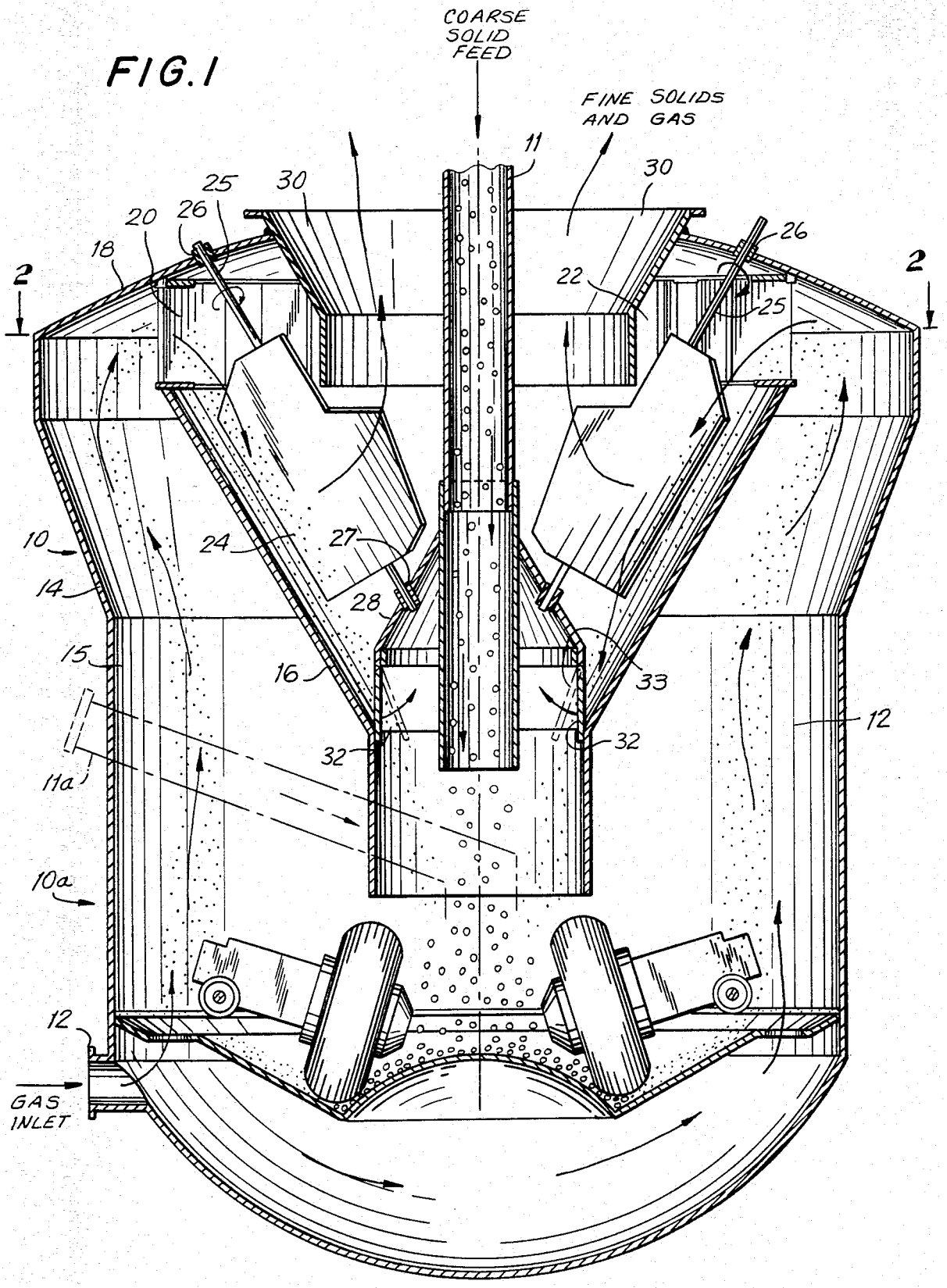
FIG. 1 is a vertical sectional view of a particle classifier constructed and operated in accordance with the invention.

This invention will be further described with reference to FIG. 1, which generally shows a particle classifier 10 which is usually mounted on top of a pulverizer device such as a conventional coal crusher mill generally shown at 10*a*. The coarse coal feed to such pulverizer preferably enters downwardly through a central conduit 11, although it could enter the pulverizer through a side conduit 11*a* as is shown by dashed lines. The pulverizer usually has an air stream supplied at conduit 12 to its lower end for carrying the crushed coal particles upwardly into the classifier through an annular passageway 15 formed by outer cylindrical housing wall 14 and inner conical shaped wall 16. The upper end of inner conical wall 16 is attached to the lower side of multiple angled circumferentially spaced vanes 20, which are also attached at their upper side to head 18.

From the annular passageway 15, the coal particles are carried by the air stream generally radially inwardly through the angled upper vanes 20, which impart a rotational or swirling motion to the airborne particles. The vanes 20, which for effective use should be at least about 10 in number and need not exceed about 30, are uniformly and circumferentially spaced and are oriented at an angle of 40°–60° with lines drawn through the vane outer ends and tangent to the outer circumference of the vanes. The vanes 20 can be fixed in position and terminate near a central exit passageway 30, which extends through the upper head 18 to at least a position adjacent to the lower sides of the vanes 20.

From vanes 20, the coal particles flow through passageway 22 and past at least three vertically inclined axially pivotable deflector vanes 24 contained therein, which vanes are each pivotably adjustable about its own axis so as to control the flow velocity and also retard the rotational motion of the larger coal particles, and thereby provide an effective separation and classification of the coal particles according to their size the deflector vanes 24 ae each inclined inwardly at its lower end to form an oblique angle of 15°–45° with the vertical centerline of the classifier. For large capacity classifiers up to about six pivotable deflector vanes 24 can be provided, with four pivotable vanes usually being preferred for most classifier applications.

From deflector vanes 24, the smaller coal particles are carried by the air stream generally radially inwardly and upwardly through the central exit passageway 30 to burners (not shown) for combustion. The remaining larger and heavier coal particles are thrown by centrifugal force and gravity action outwardly to near the inner surface of conical casing 16 and pass downwardly. These larger particles are passed through openings 32 in inner cone structure 28, which openings 32 are being closable by inwardly opening flappers 33 to prevent the undesired upward flow of air therethrough from conduit 12.

The deflector vanes 24 are each pivotally supported on pivot rods 25, which are usually oriented substantially parallel with conical surface 16. The pivot rods 25 are each attached at their upper end to upper head 18 by suitable bearings 26 and attached to lower conical structure 28 by bearings 27. The vanes 24 are each pivotable about the axis or centerline of rod 25, and are pivotably controlled at the upper end of rod 25 by external means such as a crank operated by a hydraulic or pneumatic piston (not shown). Vanes 24 pivot through an angle of 10°–45° from a radial reference plan taken through the axis of the vane rod 25 and the classifier vertical centerline, and are so positioned relative to the centrifugal flow of the airborne particles that the larger particles are directed outwardly towards conical surface 16. The velocity of the gas-solids stream passing the vanes 24 is usually in a range of 1–5 ft./sec. The particle classifier is suitable for handling particles smaller than about 50 mesh (0.012 in.), and preferably provides coal particles exiting upwardly from the classifier to the burner having the following typical size distribution:

50 mesh (0.012 in.): 98 wt. %
100 mesh (0.006 in.): 85 wt. %
200 mesh (0.003 in.): 70 wt. %

Figure 2:
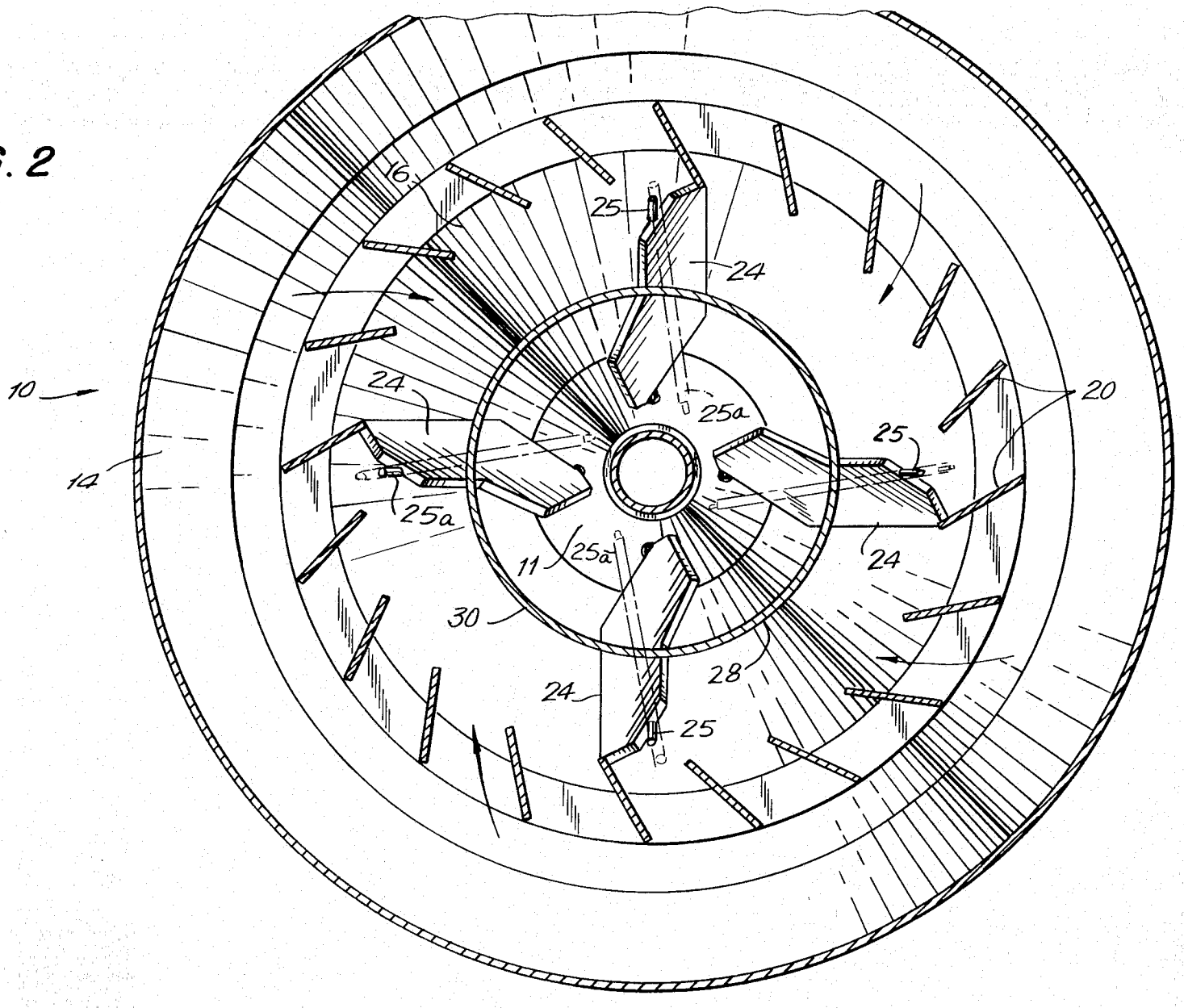
FIG. 2 is a plan view of the particle classifier taken along lines 2—2 of FIG. 1, also showing the pivotable vanes in an alternative position.

As a useful alternative configuration and embodiment of the invention, the pivotable vanes 24 can be advantageously arranged with their axis skewed relative to the classifier centerline and inclined more in the direction of the rotational flow of the airborne particles. In this alternative configuration as shown in FIG. 2, the lower end of pivot rod 25 is moved forward, i.e. in same direction as the air-solids flow flow though fixed vanes 20, so that the lower end of the rod 25 is at location 25*a* as shown by the dashed lines and the axis of pivot rod 25 is additionally inclined at an angle of 10°–30° with the vertical planes taken through the upper bearings 26 of vane rods 25 and the centerline of the classifier. Such alternative configuration of pivotable vanes provide for more effective control of the particle sizes passing through the classifier.

Although this invention has been disclosed broadly and in terms of a preferred embodiment, it is understood that other modifications and variations can be made within the spirit and scope of the invention, which is defined by the following claims.

I claim:

1. A particle classifier for separating large particles from a mixture of small and large particles carried in a gas stream, comprising:

(a) a cylindrical vertically-oriented housing having an upper head and a central opening extending through said head for removal of gas carrying fine particles;

(b) multiple angled circumferentially-spaced upper vanes attached to said upper head for imparting a rotational motion to a gas-particle solids mixture passing therethrough;

(c) an inner conical shaped casing located below and attached to the lower ends of said multiple vanes, so as to provide an annular passageway between said housing and said conical casing for upward flow of the gas-solids mixture therethrough;

(d) multiple pivotable deflector vanes mounted radially inwardly from said conical casing, each vane being pivotable about its own longitudinal axis and inclined from the vertical and located entirely within the rotational flow path of the gas carried particles, whereby the pivot angle of each said vane is adjustable at an angle from a reference plane taken through the longitudinal axis of said pivotable deflector vane and the vertical center line of said housing, so as to control the flow velocity and degree of separation of the solid particles from the gas-particle mixture; and (e) at least one closeable opening located at the lower end of said conical casing for removal of the larger separated particles from the classifier.

2. The particle classifier of claim 1, wherein said angled upper vanes are each oriented at an angle of 40°–60° with a line drawn through the vane outer end and tangent to the outer circumference of the multiple vanes.

3. The particle classifier of claim 1, wherein 10–30 fixed angled upper vanes are provided attached to said head and conical casing.

4. The particle classifier of claim 1, wherein said pivotable vanes are supported on a rod pivotably attached at its upper end to said head and at its lower end to a second conical structural member located inwardly from said conical casing.

5. The particle classifier of claim 1, wherein 3–6 pivotable deflector vanes are provided in the gas-solids stream downstream from said multiple angled upper vanes.

6. The particle classifier of claim 1, wherein the axis of said pivotable deflector vanes are inclined at an oblique angle of 15°–45° with the vertical centerline of the classifier.

7. The particle classifier of claim 1, wherein the axis of said pivotable deflector vanes is positioned substantially parallel to said conical casing.

8. The particle classifier of claim 1, wherein at least two openings equipped with closure means are provided at the bottom end of said conical casing for removal of large particles separated by the classifier from said gas-solids mixture.

9. The particle classifier of claim 1, wherein said pivotable vanes are movable through an angle of about 10°–45° with a reference plane passing through the vane axis and the classifier centerline, so as to effectively control the size of particles removed upwardly from said classifier.

10. The particle classifier of claim 1, wherein a central conduit extends vertically through said housing for feeding a coarse particle mixture into the classifier.

11. The particle classifier of claim 1, wherein the classifier is located above a crushing mill and is used in combination with said mill by returning the separated large particles to said mill for further crushing.

12. The particle classifier of claim 1, wherein the lower ends and longitudinal axis of said pivotable deflector vanes are each additionally inclined at an angle of 10°–30° with vertical planes taken through the upper end of each deflector vane and the centerline of the classifier.

13. A particle classifier for separating larger solid particles from a mixture containing small and large particles carried in a gas stream, comprising:

(a) a cylindrical vertically-oriented housing having an upper head and a central vertical conduit for feeding a coarse particle mixture into the classifier;

(b) multiple angled circumferentially-spaced upper vanes fixedly attached to said upper head for imparting a rotational motion to a gas-particle solids mixture passing therethrough;

(c) an inner conical shaped casing located below and attached to the lower ends of said multiple vanes, so as to provide an annular passageway between said housing and said conical shaped casing for the upward flow of a gas-solids mixture therethrough;

(d) multiple pivotable deflector vanes mounted radially inwardly from said conical casing and located entirely within the rotational flow path of the particles, said vanes each being pivotable about its own longitudinal axis and inclined to the vertical centerline of the classifier, whereby the pivot angle of said vanes is adjustable at an angle of 10°–45° from a radial reference plane taken through the longitudinal axis of said pivotable deflector vane and the vertical centerline of the housing, so as to control the flow velocity and the degree of separation of the larger particles from the gas-particle mixture;

(e) an exit conduit from said housing located radially inwardly above said upper vanes for upward passage of a mixture of gas and fine particle solids; and (f) an opening equipped with closure means located at the lower end of said conical casing for periodic downward removal of the larger separated particles from the classifier.

14. A method for classifying particles according to size from a mixture of small and large particles carried in a gas stream, comprising the steps of:

(a) passing the particle mixture carried by the gas stream upwardly through an annular shaped passageway in a cylindrical housing;

(b) passing said particles and gas generally radially inwardly through angled vanes and imparting a rotational motion to said gas and particles;

(c) then passing said particles generally downwardly past multiple axially pivotable deflector vanes located entirely in the rotating gas-particle stream, pivotally adjusting said deflector vanes each about its own longitudinal axis at an angle from a reference plane taken through the longitudinal axis of said pivotable deflector vane and the vertical center line of said housing, and separating the larger particles from the smaller particles by controlling the flow velocity and centrifugal forces on the particles by the angular position of said pivotable deflector vanes; and (d) removing the smaller particles along with said gas upwardly through a concentric passageway, while returning the larger particles to the lower end of said housing of the classifier.

15. The method of claim 14, wherein the velocity of particles flowing past the pivotable deflector vanes is 1–5 ft. per sec.

16. The method of claim 14, wherein coarse particles are first passed downwardly through a central conduit through said classifier to a crushing step, from which said mixture of small and large particles is carried by gas upwardly into said classifier.

17. The method of claim 14, wherein said particles mixture is crushed coal having a particle size range of 40–400 mesh (U.S. Sieve Series).

18. A method for classifying coal particles according to size from a mixture of small and large particles carried in a gas stream, comprising the steps of:

(a) crushing coarse coal particles in a crushing step and passing an airborne particle mixture upwardly through an annular passageway in a cylindrical housing;

(b) passing the coal particles and gas generally radially inwardly through multiple angled vanes and imparting a rotational motion to said gas and particles;

(c) then passing said particles generally downwardly past multiple pivotable deflector vanes located in the rotating gas-solids stream, said particles flowing past said pivotable vanes at a particle velocity of 1–5 ft/sec;

(d) pivotally adjusting said deflector vanes each about its own longitudinal axis, within an angle of 10°–45° from a radial reference plane taken through the longitudinal axis of said pivotable deflector vane and the vertical centerline of the housing and separating the larger particles from the smaller particles by controlling the flow velocity and centrifugal forces on the particles by the angular position of said pivotable deflector vanes; and (e) removing the smaller particles along with said gas upwardly through a concentric passageway, while returning the larger particles to the lower end of said housing of the classifier.

* * * * *